US010792798B2

(12) United States Patent
Liaw

(10) Patent No.: US 10,792,798 B2
(45) Date of Patent: Oct. 6, 2020

(54) PNEUMATIC HAMMER

(71) Applicant: Jian-Shiou Liaw, Taichung (TW)

(72) Inventor: Jian-Shiou Liaw, Taichung (TW)

( * ) Notice: Subject to any disclaimer, the term of this patent is extended or adjusted under 35 U.S.C. 154(b) by 142 days.

(21) Appl. No.: 16/128,954

(22) Filed: Sep. 12, 2018

(65) Prior Publication Data

US 2020/0078917 A1 Mar. 12, 2020

(51) Int. Cl.

*B25D 9/00* (2006.01)
*B25D 9/02* (2006.01)
*B25D 9/20* (2006.01)

(52) U.S. Cl.

CPC ..... *B25D 9/02* (2013.01); *B25D 9/20* (2013.01); *B25D 2209/007* (2013.01); *B25D 2250/065* (2013.01); *B25D 2250/111* (2013.01)

(58) Field of Classification Search

CPC ..... B65D 9/02; B65D 9/20; B65D 2209/007
See application file for complete search history.

(56) References Cited

U.S. PATENT DOCUMENTS 5,417,294 A * 5/1995 Suher ..... B25D 9/14 173/15
5,913,370 A * 6/1999 Chapelle ..... B25F 5/001 173/169
6,161,628 A * 12/2000 Liu ..... B25D 9/20 173/114
6,517,297 B2 * 2/2003 Cochran ..... B23B 31/005 279/30
6,668,942 B1 * 12/2003 Lin ..... B25D 17/24 173/162.1
7,891,275 B2 * 2/2011 Huang ..... B25B 23/0035 279/75
8,240,394 B2 * 8/2012 Kobayashi ..... B25D 9/18 173/162.1
8,550,471 B2 * 10/2013 Huang ..... B23B 31/06 279/22
9,381,627 B2 * 7/2016 Chen ..... B25B 23/12
9,844,867 B2 * 12/2017 Hsieh ..... B25D 17/24
2017/0298728 A1 * 10/2017 Liaw ..... E21C 35/18

* cited by examiner

*Primary Examiner* — Andrew M Tecco
*Assistant Examiner* — Eyamindae C Jallow
(74) *Attorney, Agent, or Firm* — Karin L. Williams; Mayer & Williams PC

(57) ABSTRACT

A pneumatic hammer has a handle, a body, a valve seat, a cylinder device, an assembling device, and a chisel. The body is transversally connected to the handle and has a chamber. The valve seat is mounted in the chamber of the body and has a rear valve, a front valve, and a valve plate disposed between the rear valve and the front valve. The cylinder device is mounted in the chamber, abuts against the valve seat, and has a cylinder barrel and a hammer. The cylinder barrel is mounted in the chamber and has a cylinder chamber. The hammer is movably disposed in the cylinder chamber. The assembling device is connected to the cylinder device, and has a mounting jacket, an engaging element, multiple positioning elements, a spring, and an engaging ring. The chisel is detachably connected to the assembling device, and is inserted into the cylinder chamber.

8 Claims, 17 Drawing Sheets

PNEUMATIC HAMMER

BACKGROUND OF THE INVENTION

1. Field of the Invention

The present invention relates to a pneumatic hammer, and more particularly to a pneumatic hammer that may be assembled easily and quickly.

2. Description of Related Art

With reference to FIGS. 15 and 16, an assembling device 80 for a conventional pneumatic hammer has a mounting jacket 81, an elastic element 82, a mounting element 83, an engaging ring 84, multiple positioning elements 85, and a chisel 86. The mounting jacket 81 has a bottom, a top, a connecting mount 811, and an assembling portion 812. The connecting mount 811 is hollow, is disposed on the bottom of the mounting jacket 81 and has an outer diameter. The assembling portion 812 is hollow, is disposed on the top of the mounting jacket 81 above the connecting mount 811, and has an outer diameter. The outer diameter of the assembling portion 812 is smaller than the outer diameter of the connecting mount 811 to form a stepped flange between the connecting mount 811 and the assembling portion 812.

Furthermore, the assembling portion 812 has multiple assembling holes 813, an assembling chamber 814, and an engaging recess 815. The assembling holes 813 are radially formed through an external surface of the assembling portion 812 at spaced intervals away from the connecting mount 811. The assembling chamber 814 is axially formed in the assembling portion 812 and communicates with the assembling holes 813 and the connecting mount 811. The engaging recess 815 is formed on the external surface of the assembling portion 812 above the assembling holes 813. The elastic element 82 is compressibly mounted around the assembling portion 812 of the mounting jacket 81 and has an end abutting against the stepped flange between the connecting mount 811 and the assembling portion 812.

The mounting element 83 is movably mounted around the assembling portion 812 of the mounting jacket 81 to hold the elastic element 82 between the mounting element 83 and the mounting jacket 81. The mounting element 83 is a hollow tube and has an abutting flange 831, an engaging rib 832, and a receiving recess 833. The abutting flange 831 is annularly formed on and radially protrudes from an internal surface of the mounting element 83 at a middle of the mounting element 83. The elastic element 82 is held between the abutting flange 831 of the mounting element 83 and the stepped flange of the mounting jacket 81. The engaging rib 832 is annularly formed on the internal surface of the mounting element 83 at a top end of the mounting element 83. The receiving recess 833 is annularly formed in the internal surface of the mounting element 83 between the abutting flange 831 and the engaging rib 832, and communicates with the assembling holes 813.

The engaging ring 84 is disposed in the engaging recess 815 of the assembling portion 812 and abuts against the engaging rib 832 of the mounting element 83 to prevent the mounting element 83 separating from the mounting jacket 81 by the elastic element 82. Each one of the positioning elements 85 is disposed in a respective one of the assembling holes 813 of the assembling portion 812, partially extends into the receiving recess 833 of the mounting element 83, and abuts against the abutting flange 831.

The chisel 86 is detachably disposed in the mounting jacket 81 and has a connecting segment 861, a connecting rib 862, and a handle segment 863. The connecting segment 861 is disposed on a lower end of the chisel 86 and has a curved top end. The connecting rib 862 is disposed on the curved top end of the connecting segment 861. The handle segment 863 is disposed on a top end of the connecting rib 862 away from the connecting segment 861. The connecting rib 862 has an outer diameter larger than those of the connecting segment 861 and the handle segment 863.

In use, with reference to FIG. 17, the mounting element 83 of the assembling device 80 of the conventional pneumatic hammer is pressed to move downwardly to compress the elastic element 82 by the abutting flange 831 of the mounting element 83. At the same time, the connecting segment 861 of the chisel 86 moves into the assembling chamber 814 of the assembling portion 812 of the mounting jacket 81. During the movement of the chisel 86, the curved top end of the connecting segment 861 pushes the positioning elements 85 to move toward the receiving recess 833, and the chisel 70 is further pushed to move downwardly until the connecting rib 862 of the chisel 86 moves below the positioning elements 85. Then, the mounting element 83 is released, and the compressed elastic element 82 is deformed backwardly to push the mounting element 83 to return to the original position.

When the mounting element 83 moves back to the original position by the elastic element 82, the engaging rib 832 of the mounting element 83 abuts against and is limited by the engaging ring 84, and this enables the positioning elements 85 to move back to the original positions and abut against the connecting rib 862 of the chisel 86 to provide a limiting effect to the chisel 86. However, during the process of assembling the chisel 86 of the assembling device 80 of the conventional pneumatic hammer, one hand of a user needs to push the mounting element 83, and the other hand of the user needs to insert the chisel 86 into the assembling device 80, and this is inconvenient in assembly.

To overcome the shortcomings, the present invention tends to provide a pneumatic hammer to mitigate or obviate the aforementioned problems.

SUMMARY OF THE INVENTION

The main objective of the present invention is to provide a pneumatic hammer that may be assembled easily and quickly.

The pneumatic hammer in accordance with the present invention has a handle, a body, a valve seat, a cylinder device, an assembling device, and a chisel. The body is transversally connected to the handle and has a chamber. The valve seat is mounted in the chamber of the body and has a rear valve, a front valve, and a valve plate disposed between the rear valve and the front valve. The cylinder device is mounted in the chamber of the body, abuts against the valve seat, and has a cylinder barrel and a hammer. The cylinder barrel is mounted in the chamber and has a cylinder chamber. The hammer is movably disposed in the cylinder chamber. The assembling device is connected to the cylinder device opposite to the valve seat, and has a mounting jacket, an engaging element, multiple positioning elements, a spring, and an engaging ring. The chisel is detachably connected to the assembling device, and is inserted into the cylinder chamber of the cylinder barrel.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
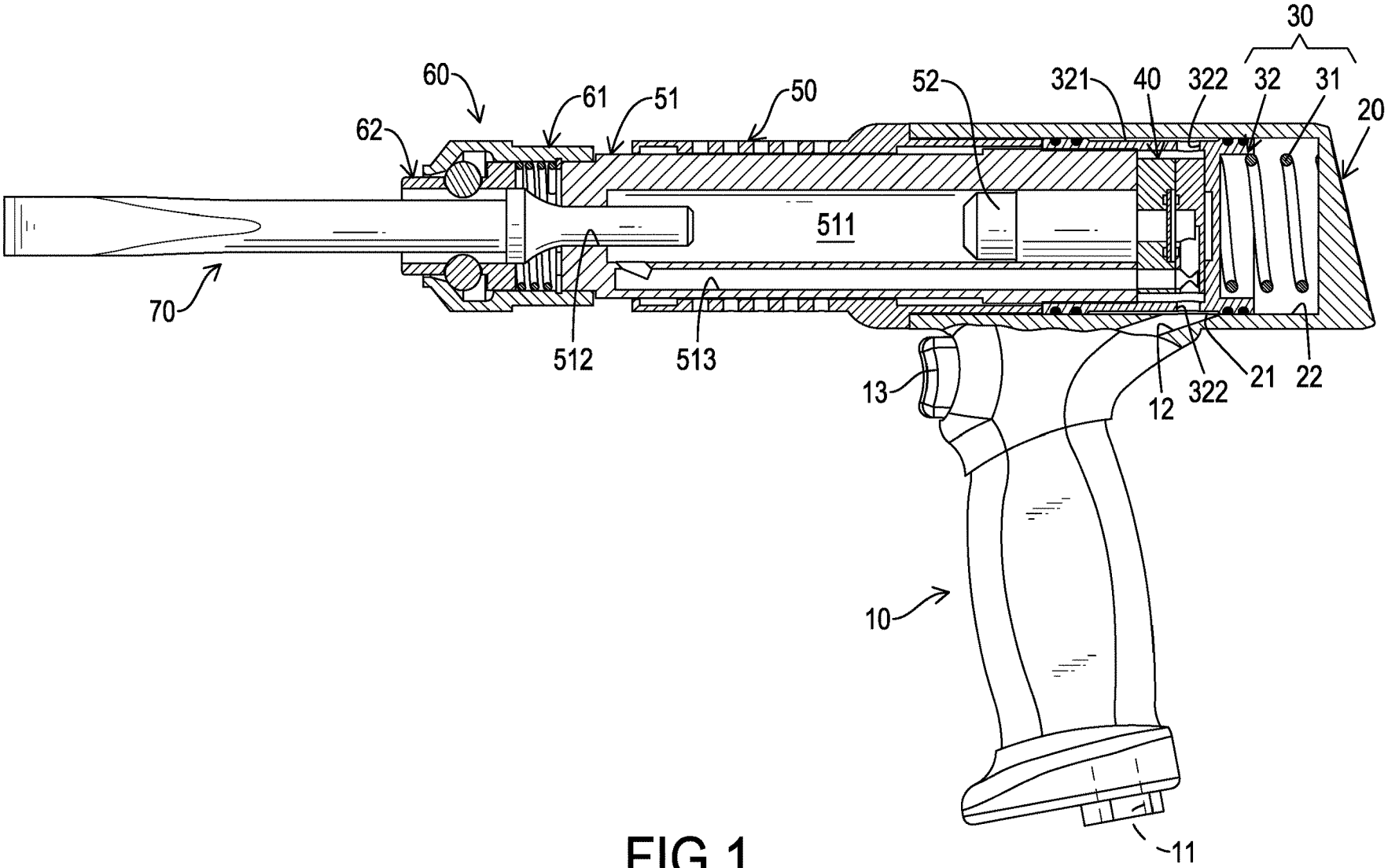
FIG. 1 is a side view in partial section of a pneumatic hammer in accordance with the present invention.
Figure 2:
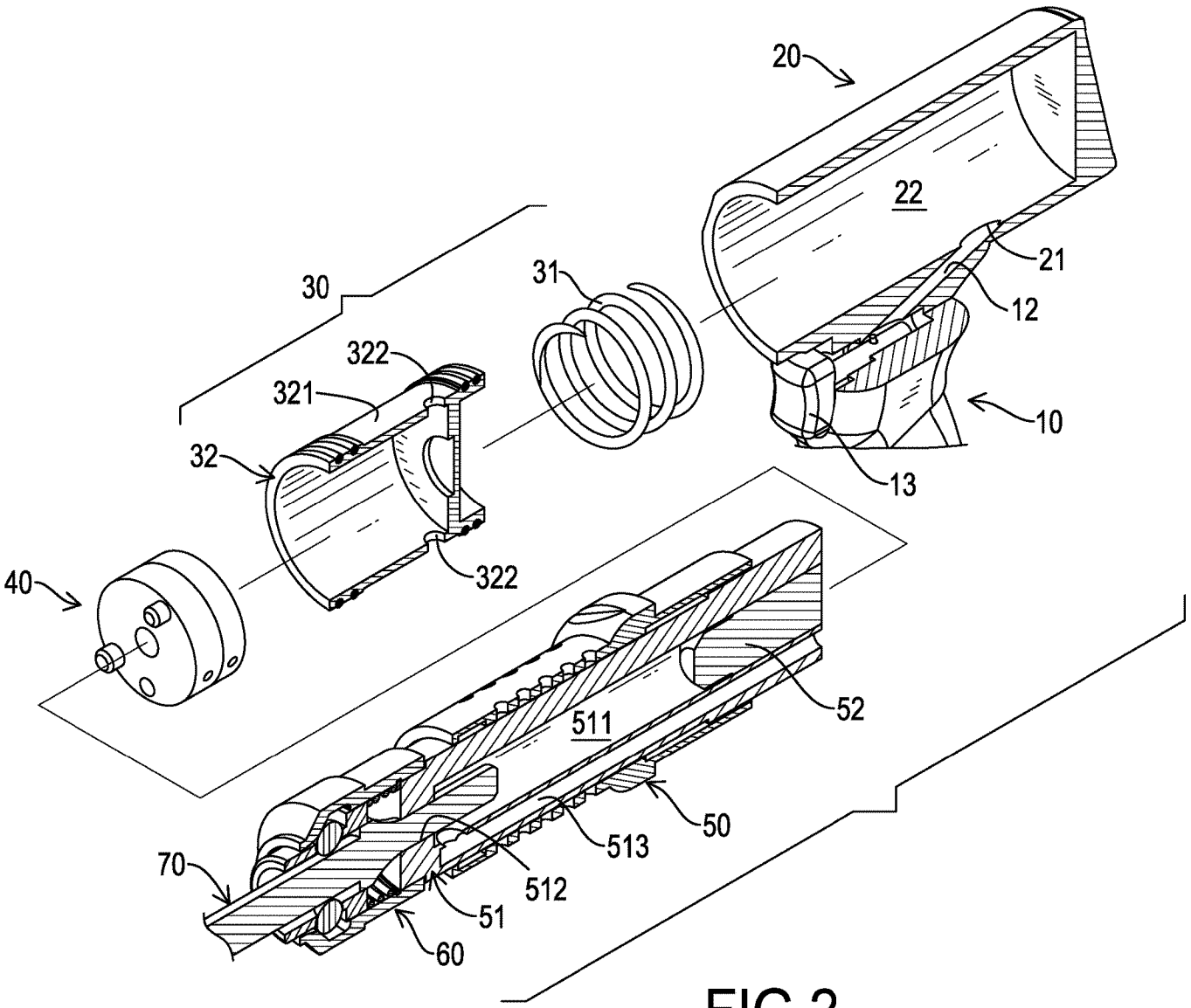
FIG. 2 is an exploded and cross sectional perspective view of the pneumatic hammer in FIG. 1.
Figure 3:
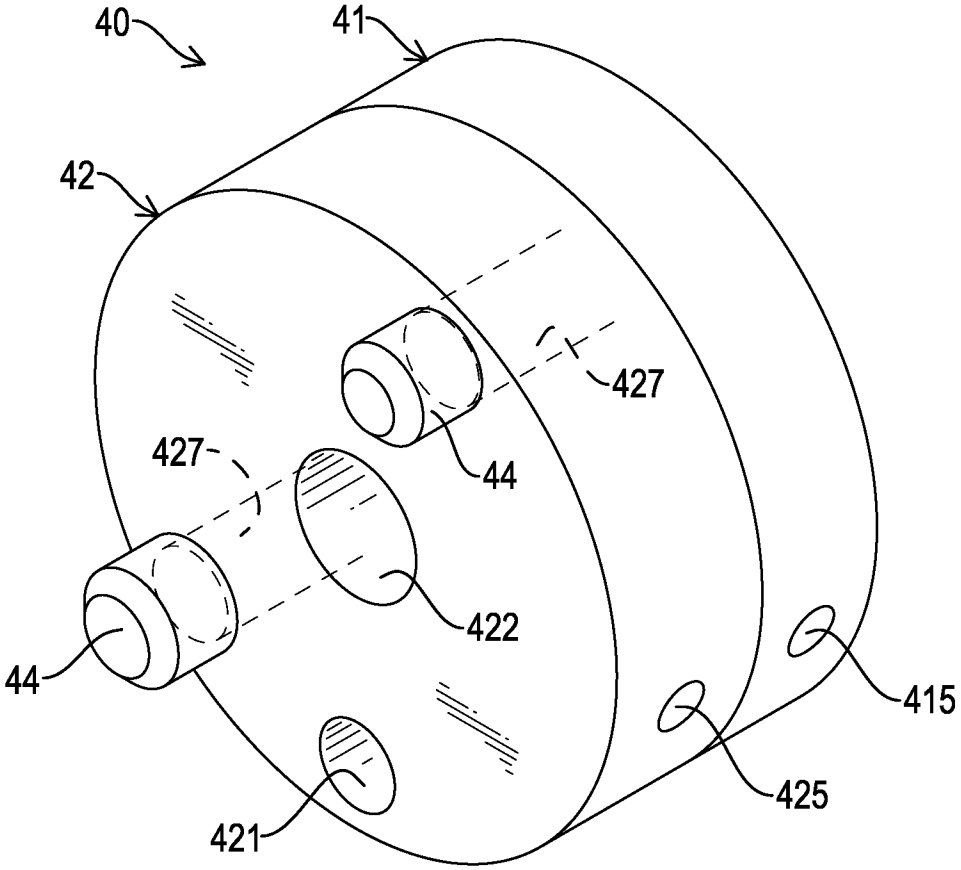
FIG. 3 is an enlarged perspective view of a valve seat of the pneumatic hammer in FIG. 1.
Figure 4:
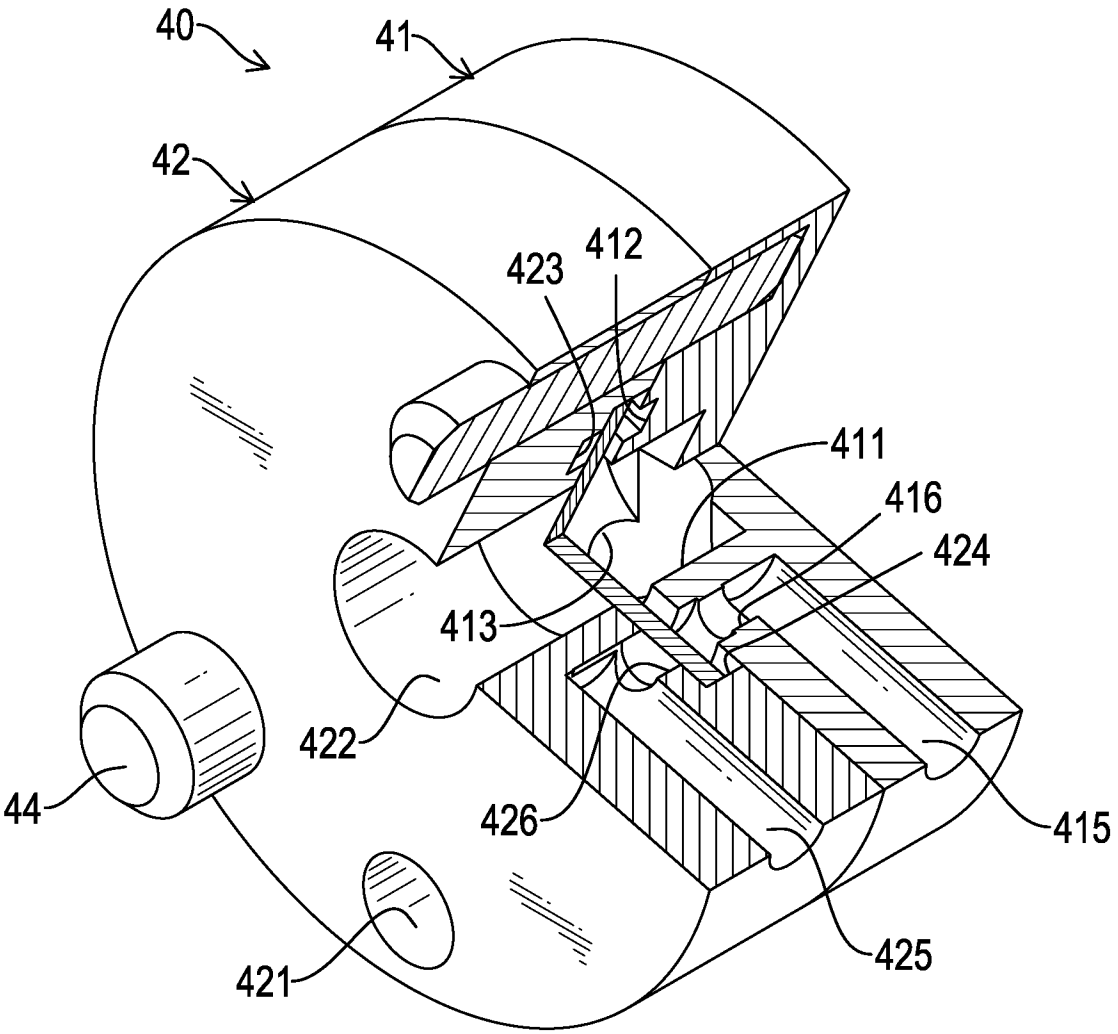
FIG. 4 is cross sectional perspective view of the valve seat of the pneumatic hammer in FIG. 3.
Figure 5:
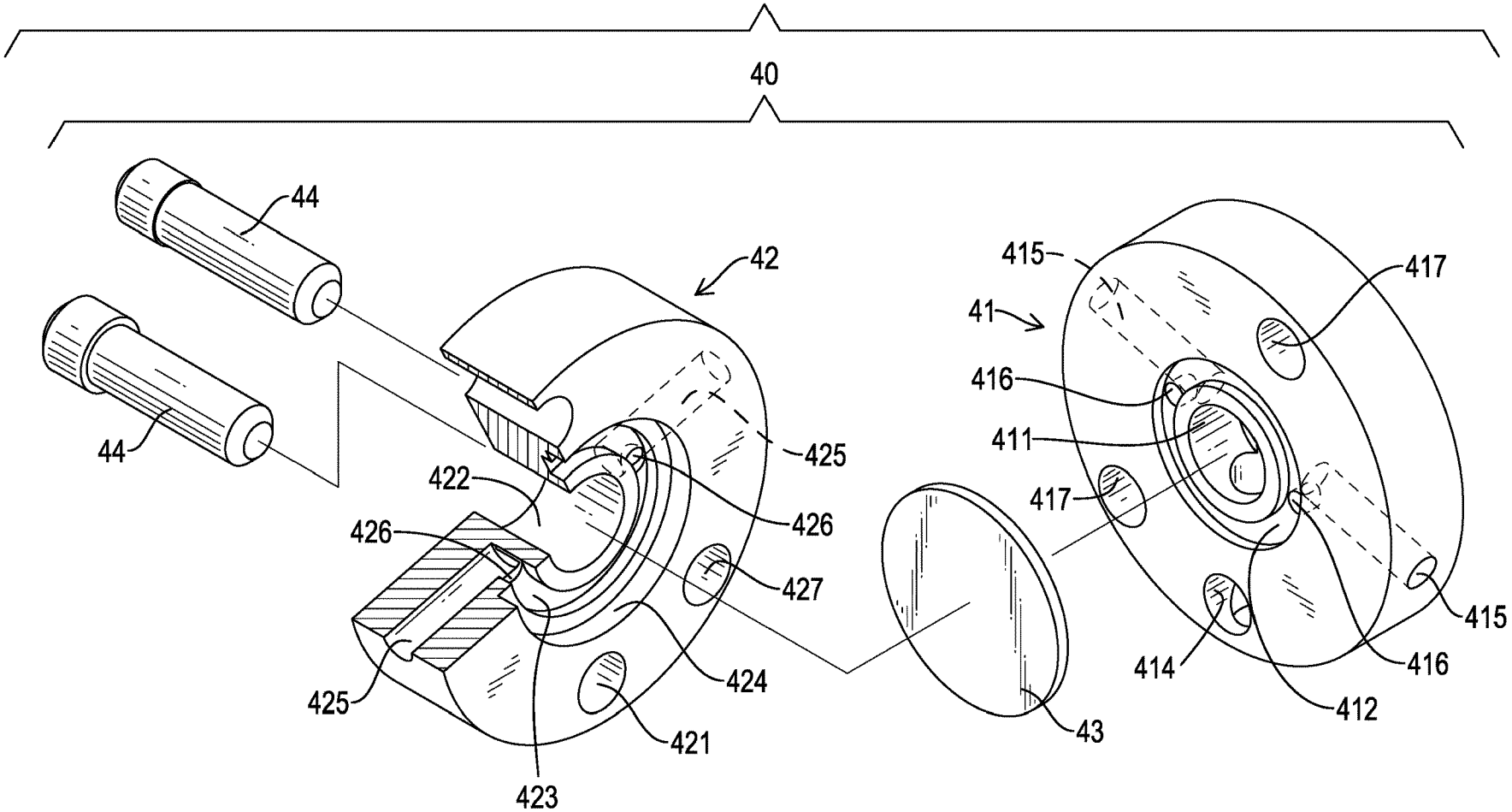
FIG. 5 is an exploded perspective view of the valve seat of the pneumatic hammer in FIG. 3.
Figure 6:
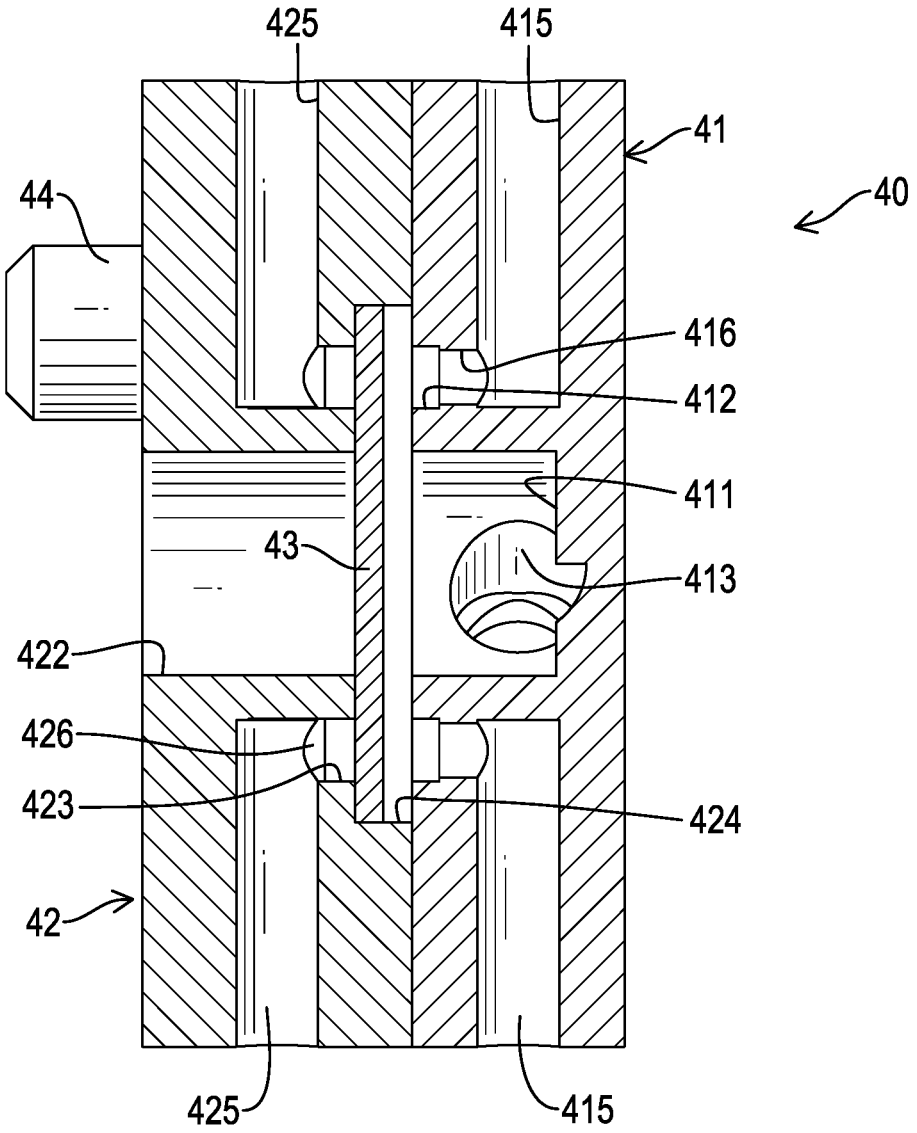
FIG. 6 is a cross sectional top side view of the valve seat of the pneumatic hammer in FIG. 3.

With reference to FIGS. 1 and 2, a pneumatic hammer in accordance with the present invention has a handle 10, a body 20, an anti-shock device 30, a valve seat 40, a cylinder device 50, an assembling device 60, and a chisel 70.

The handle 10 has a bottom, a top, an external surface, an intake port 11, an air passage, a wind passage 12, and a switch 13. The intake port 11 is disposed on the bottom of the handle 10 and is used to connect with an air compressor. The air passage is formed in the handle 10 and communicates with the intake port 11. The wind passage 12 is disposed on the top of the handle 10 and selectively communicates with the air passage of the handle 10. The switch 13 is pressably disposed on the external surface of the handle 10 to control whether the wind passage 12 communicates with the air passage of the handle 10.

The compressed air that is provided by the air compressor flows into the air passage of the handle 10 via the intake port 11, and further flows into the wind passage 12 when the switch 13 is pressed. Furthermore, when the switch 13 is released, the air passage does not communicate with the wind passage 12, and the compressed air of the air compressor cannot flow into the wind passage 12. The body 20 is transversally connected to the top of the handle 10, communicates with the wind passage 12, and has a closed end, an open end, an external surface, a vent 21, and a chamber 22. The vent 21 is formed through the external surface of the body 20 adjacent to the closed end of the body 20 and communicates with the wind passage 12 of the handle 10. The chamber 22 is formed in the body 20 between the closed end and the open end of the body 20 and communicates with the vent 21 and the open end of the body 20.

The anti-shock device 30 is mounted in the chamber 22 of the body 20 adjacent to the closed end of the body 20, and has an elastic element 31 and an anti-shock mount 32. The elastic element 31 is mounted in the chamber 22 of the body 20 and has two ends. One of the two ends of the elastic element 31 abuts against the closed end of the body 20. The anti-shock mount 32 is mounted in the chamber 22 of the body 20 opposite to the closed end of the body 20, and has a closed end, an open end, an external surface, an annular recess 321, two air inlets 322, and a mounting room. The annular recess 321 is annularly formed on the external surface of the anti-shock mount 32 between the closed end and the open end of the anti-shock mount 32, and an annular space is formed between the annular recess 321 and the chamber 22 and communicates with the vent 21 of the body 20.

The air inlets 322 are radially formed through the external surface of the anti-shock mount adjacent to the closed end of the anti-shock mount 32, align with each other, and communicate with the annular space. The mounting room is formed in the anti-shock mount 32 between the closed end and the open end of the anti-shock mount 32, and communicates with the air inlets 322 and the open end of the anti-shock mount 32. When the compressed air flows into the wind passage 12 of the handle 10, the compressed air may flow into the annular space that is formed by the annular recess 321 and the chamber 22 of the body 20 via the vent 21 of the body 20, and may flow into the mounting room of the anti-shock mount 32 via the air inlets 322.

With reference to FIGS. 1 and 3 to 6, the valve seat 40 is mounted in the mounting room of the anti-shock mount 32 of the anti-shock device 30 adjacent to the closed end of the anti-shock mount 32, and has a rear valve 41, a front valve 42, a valve plate 43, and two fixing pins 44.

The rear valve 41 is an annular body, is made of carbon fiber materials, and is mounted in the mounting room of the anti-shock mount 32 adjacent to the closed end of the anti-shock mount 32. The rear valve 41 has a rear side, a front side, an external surface, a center, an inlet recess 411, an annular groove 412, an inlet passage 413, an exhaust port 414, two inlet channels 415, two exhaust channels 416, and two fixing holes 417. The inlet recess 411 is formed in the front side of the rear valve 41 at the center of the rear valve 41 opposite to the closed end of the anti-shock mount 32. The annular groove 412 is annularly formed in the front side of the rear valve 41 around the inlet recess 411 at a spaced interval from the inlet recess 411. Furthermore, a stepped flange is formed between the annular groove 412 and the inlet recess 411.

The inlet passage 413 is radially formed through the external surface of the rear valve 41, and communicates with the inlet recess 411 and the mounting room of the anti-shock mount 32. The exhaust port 414 is axially formed in the front side of the rear valve 41 and communicates with the inlet recess 411. The inlet channels 415 are radially formed through the external surface of the rear valve 41 and align with each other. The exhaust channels 416 are axially formed in a front side of the annular groove 412, and respectively communicate with the inlet channels 415. Then, each one of the exhaust channels 416 and a corresponding inlet channel 415 form an L-shaped air channel to communicate with the annular groove 412. The fixing holes 417 are axially formed through the front side of the rear valve 41.

With reference to FIGS. 1 and 3 to 6, the front valve 42 is an annular body, is made of carbon fiber materials, and is mounted in the mounting room of the anti-shock mount 32 adjacent to the rear valve 41. The front valve 42 has a rear side, a front side, an external surface, a center, an exhaust port 421, an inlet hole 422, an annular groove 423, a movement space 424, two inlet channels 425, two exhaust channels 426, and two fixing holes 427. The exhaust port 421 is axially formed through the front side and the rear side of the front valve 42, and aligns with and communicates with the exhaust port 414 of the rear valve 41. The inlet hole 422 is formed through the front side and the rear side of the front valve 42 at the center of the front valve 42, and aligns with and communicates with the inlet recess 411 of the rear valve 41. The annular groove 423 is annularly formed in the rear side of the front valve 42 around the inlet hole 422 at a spaced interval from the inlet hole 422. Furthermore, a stepped flange is formed between the annular groove 423 and the inlet hole 422.

The movement space 424 is formed in the rear side of the front valve 42 around the annular groove 423, and communicates with the exhaust channels 416 of the rear valve 41. Additionally, a stepped flange is formed between the movement space 424 and the annular groove 423 of the front valve 42. The inlet channels 425 are radially formed through the external surface of the front valve 42 and align with each other. The exhaust channels 426 are axially formed in a rear side of the annular groove 423, and respectively communicate with the inlet channels 425. Then, each one of the exhaust channels 426 and a corresponding inlet channel 425 form an L-shaped air channel to communicate with the annular groove 423. Furthermore, the exhaust channels 426 of the front valve 42 respectively align with the exhaust channels 416 of the rear valve 41, and the exhaust channels 426 of the front valve 42 communicate with the movement space 424. The fixing holes 427 are axially formed through the front side and the rear side of the front valve 42, and respectively align with the fixing holes 417 of the rear valve 41.

The valve plate 43 is an annular disk, is made of carbon fiber materials, and is movably deposited in the movement space 424 of the front valve 42 between the front valve 42 and the rear valve 41. The valve plate 30 has an outer diameter corresponding to an inner diameter of the movement space 424. Each one of the fixing pins 44 is mounted through a corresponding one of the fixing holes 427 of the front valve 42, and is connected to one of the fixing holes 417 of the rear valve 41 that aligns with the corresponding one of the fixing holes 427 of the front valve 42. Then, the front valve 42 is connected to and abuts against the rear valve 41 by the fixing pins 44. Since the rear valve 41, the front valve 42, and the valve plate 43 are made of carbon fiber materials, the structural strength of the valve seat 40 is sufficient to prevent cracking or damaging after a long time use and the total weight of the valve seat 40 can be reduced.

With reference to FIGS. 1 and 2, the cylinder device 50 is mounted in the chamber 22 of the body 20 via the open end of the body 20, abuts against the front side of the front valve 42 of the valve seat 40, and has a cylinder barrel 51 and a hammer 52. The cylinder barrel 51 is mounted in the chamber 22 of the body 20 via the open end of the body 20, abuts against the front side of the front valve 42, and has a rear end, a front end, a cylinder chamber 511, a through hole 512, and a cylinder channel 513. The rear end of the cylinder barrel 51 abuts against the front side of the front valve 42. The cylinder chamber 511 is axially formed in the cylinder barrel 51 between the rear end and the front end of the cylinder barrel 51, and communicates with the inlet hole 422 of the front valve 42 of the valve seat 40. The through hole 512 is axially formed through the front end of the cylinder barrel 51, communicates with the cylinder chamber 511, and has an inner diameter smaller than an inner diameter of the cylinder chamber 511. The cylinder channel 513 is axially formed in the cylinder barrel 51, is parallel with the cylinder chamber 511, and communicates with the cylinder chamber 511 adjacent to the through hole 512, and communicates with the exhaust port 421 of the front valve 42 of the valve seat 40 adjacent to the rear end of the cylinder barrel 51. In addition, a lower flow channel is formed by the exhaust port 414 of the rear valve 41, the exhaust port 421 of the front valve 42, and the cylinder channel 513 of the cylinder barrel 51. The hammer 52 is axially and movably mounted in the cylinder chamber 511 of the cylinder barrel 51.

With reference to FIGS. 1 and 7 to 9, the assembling device 60 is connected to the cylinder barrel 51 of the cylinder device 50 opposite to the valve seat 40, communicates with the through hole 512 of the cylinder barrel 51, and has a mounting jacket 61, an engaging element 62, multiple positioning elements 63, a spring 64, and an engaging ring 65. The mounting jacket 61 is hollow and has a rear end, a front end, an internal surface, an assembling chamber 611, an engaging recess 612, and a mounting recess 613. The assembling chamber 611 is formed in the mounting jacket 61 adjacent to the rear end of the mounting jacket 61, and communicates with the through hole 512 of the cylinder barrel 51. The engaging recess 612 is annularly formed in the internal surface of the mounting jacket 61 adjacent to the assembling chamber 611 and opposite to the rear end of the mounting jacket 61. The mounting recess 613 is conical, is formed in the mounting jacket 61 adjacent to the front end of the mounting jacket 61, communicates with the assembling chamber 611, and has a rear flange 614 and a front flange 615. The rear flange 614 is formed in the internal surface of the mounting jacket 61 adjacent to the assembling chamber 611. The front flange 615 is tapered and is formed in the internal surface of the mounting jacket 61 adjacent to the front end of the mounting jacket 61.

Figure 7:
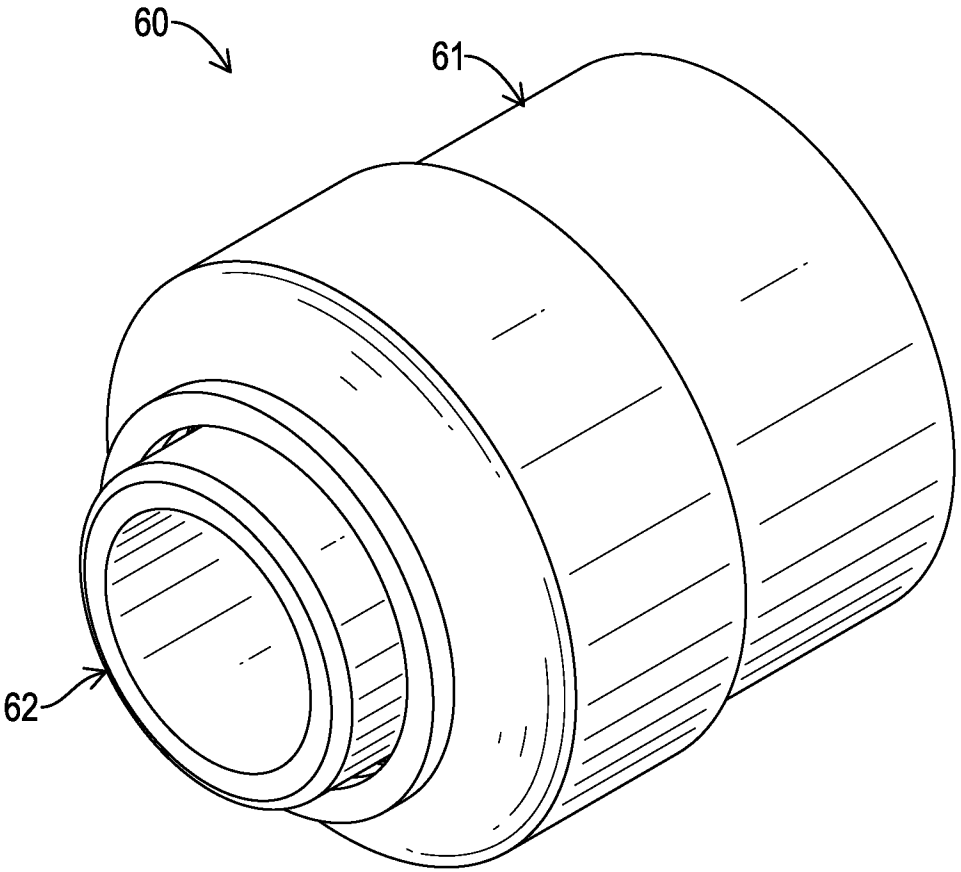
FIG. 7 is an enlarged perspective view of an assembling device of the pneumatic hammer in FIG. 1.
Figure 8:
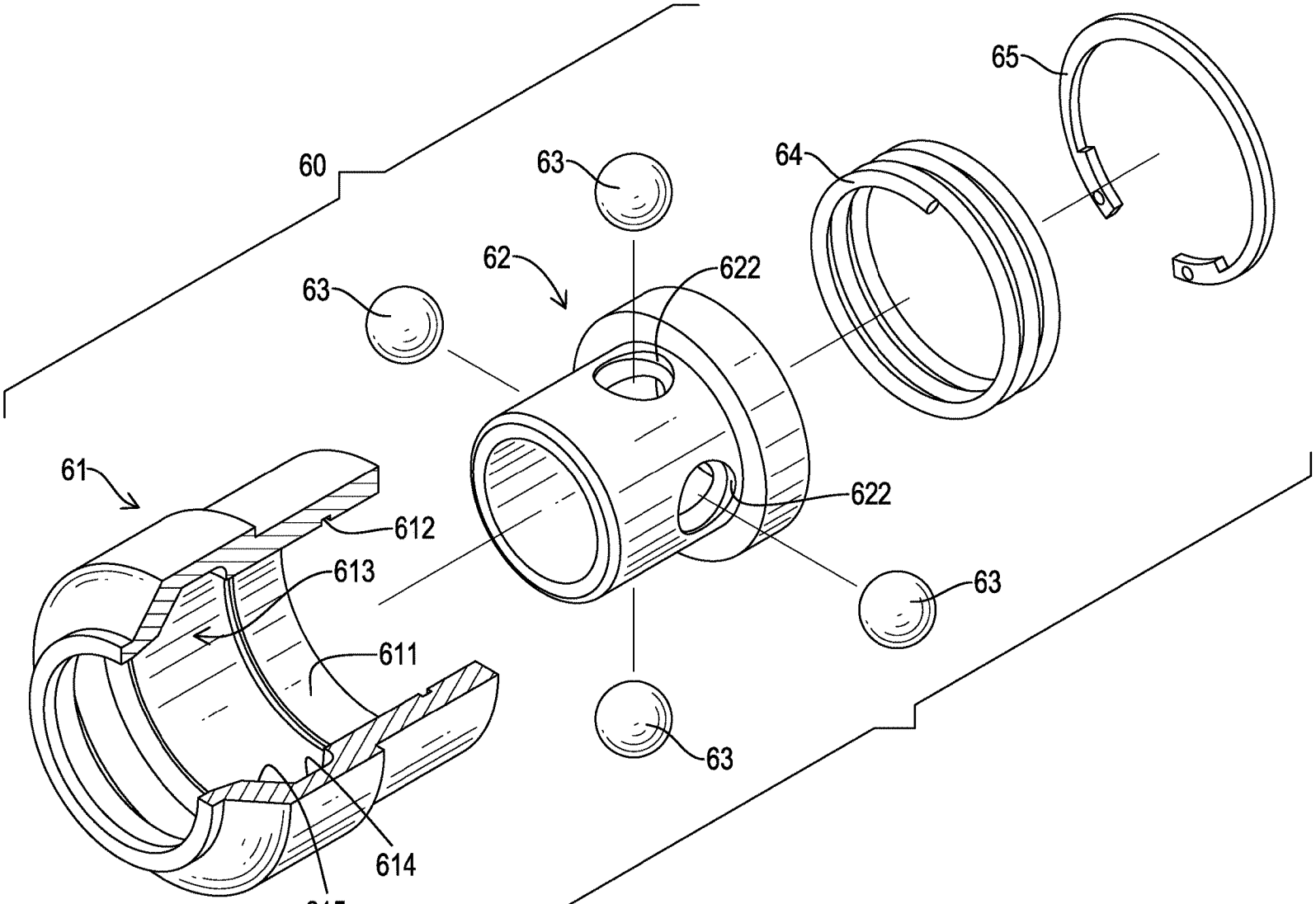
FIG. 8 is an exploded perspective view of the assembling device of the pneumatic hammer in FIG. 7.
Figure 9:
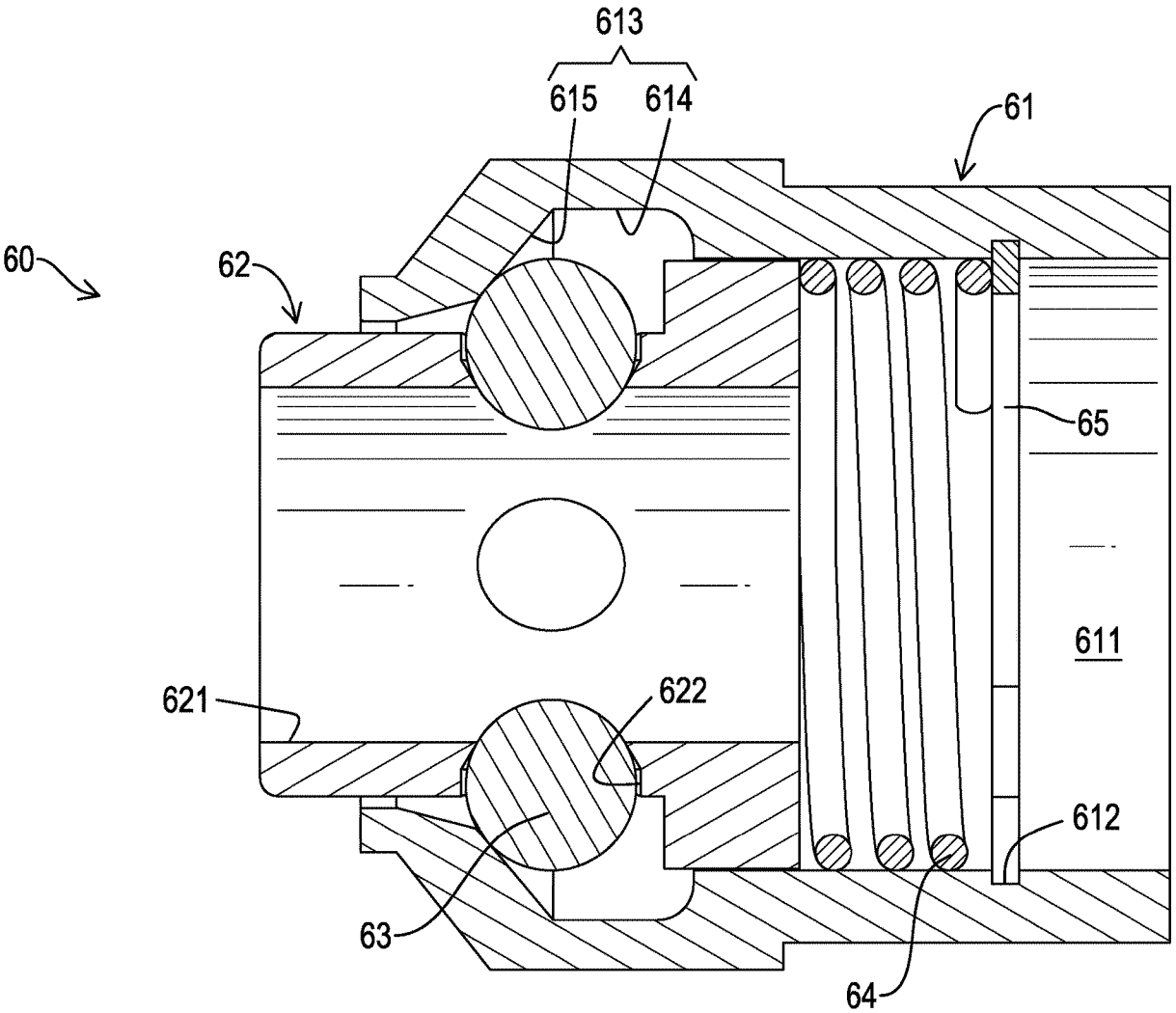
FIG. 9 is a cross sectional side view of the assembling device of the pneumatic hammer in FIG. 7.

With reference to FIGS. 7 to 9, the engaging element 62 is mounted in the mounting jacket 61 via the assembling chamber 611, extends out of the front end of the mounting jacket 61 via the mounting recess 613, and is a hollow tube. The engaging element 62 has a front end, a rear end, an external surface, a communicating hole 621 and multiple assembling holes 622. The front end of the engaging element 62 extends out of the front end of the mounting jacket 61 via the mounting recess 613. The communicating hole 621 is axially formed through the front end and the rear end of the engaging element 62 and communicates with the assembling chamber 611 of the mounting jacket 61. The assembling holes 622 are radially formed through the external surface of the engaging element 62 at spaced intervals, and communicate with the communicating hole 621 and the mounting recess 613 of the mounting jacket 61.

The positioning elements 63 are respectively and movably mounted in the assembling holes 622 of the engaging element 62, partially extend into the mounting recess 613 of the mounting jacket 61, and abut against the front flange 615 of the mounting recess 613 of the mounting jacket 61. Furthermore, each one of the assembling holes 622 has two sectional inner diameters, one of the sectional inner diameters is disposed adjacent to the communicating hole 621, and the other one of the sectional inner diameters is disposed adjacent to the mounting recess 613 and is larger than the sectional inner diameter that is disposed adjacent to the communicating hole 621. Then, the positioning elements 63 can be respectively held in the assembling holes 622 without falling in the communicating hole 621.

With reference to FIGS. 7 to 9, the spring 64 is mounted in the assembling chamber 611 of the mounting jacket 61 and abuts against the rear end of the engaging element 62. The engaging ring 65 is disposed in the engaging recess 612 of the mounting jacket 61 and abuts against the spring 62. Then, the spring 62 is held in the mounting jacket 61 between the engaging element 62 and the engaging ring 65, and the engaging element 62 is held in the mounting jacket 61 by the positioning elements 63, the spring 64, and the engaging ring 65.

Figure 10:
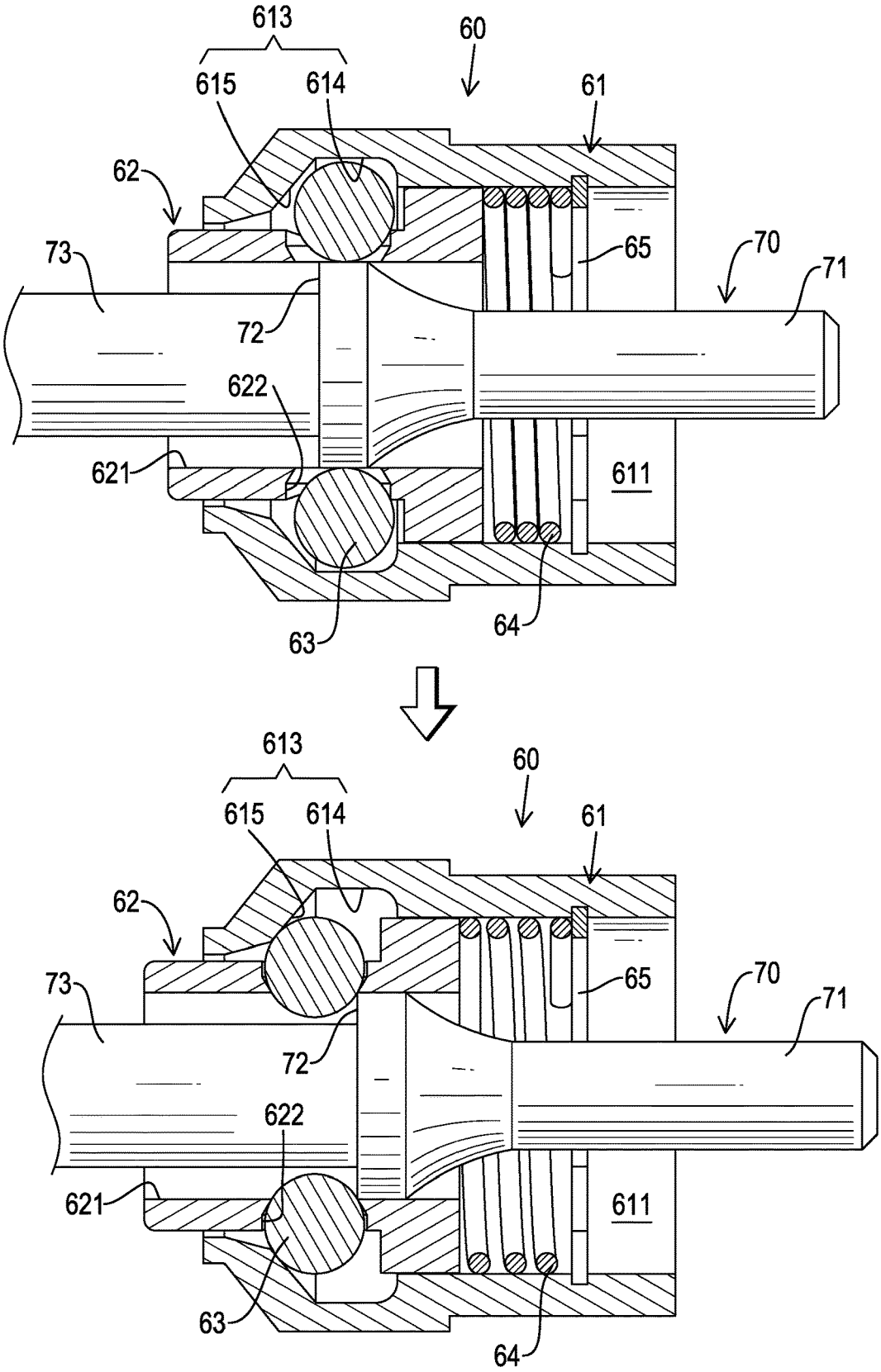
FIG. 10 shows operational side views in partial section of the assembling device of the pneumatic hammer in FIG. 7.

With reference to FIGS. 1 and 10, the chisel 70 is detachably connected to the assembling device 60, is inserted into the cylinder chamber 511 of the cylinder barrel 51 via the through hole 512, and has a rear end, a front end, a connecting segment 71, a connecting rib 72, and a handle segment 73. The connecting segment 71 is disposed on the rear end of the chisel 70 and has a free end and a curved end opposite to the free end. The connecting rib 72 is connected to the curved end of the connecting segment 71 and has an outer diameter. The handle segment 73 is connected to the connecting rib 72 opposite to the connecting segment 71. The outer diameter of the connecting rib 72 is larger than those of the connecting segment 71 and the handle segment 73.

In assembly, the connecting segment 71 of the chisel 70 is inserted into the assembling device 60 and extends through the communicating hole 621 of the engaging element 62, the spring 64, and the engaging ring 65, and the free end of the connecting segment 71 extends out of the mounting jacket 61 and extends into the cylinder chamber 511 of the cylinder barrel 51 via the through hole 512. During the above inserting process, the curved end of the connecting segment 71 abuts against and pushes the positioning elements 63 to move outwardly to the rear flange 614 of the mounting recess 613 of the mounting jacket 61, and this may move the engaging element 62 toward the engaging ring 65 to compress the spring 64. When the connecting rib 72 moves inwardly to cross the positioning elements 63, the compressed spring 64 pushes the engaging element 62 back to the original position, and the positioning elements 63 abut against the front flange 615 of the mounting recess 613. Then, the chisel 70 is securely held with the assembling device 60 by the positioning elements 63 between the mounting jacket 61 and the engaging element 62.

Since the mounting jacket 61 is mounted around the engaging element 62 and has the mounting recess 613 to communicate with the assembling holes 622, the chisel 70 can be easily and quickly connected to the assembling device 60 by the positioning elements 63 between the mounting jacket 61 and the engaging element 62. Consequently, in assembly, a user only needs to push the chisel 70 into the assembling device 60 by one hand, and then the chisel 70 can be held with the pneumatic hammer by the assembling device 60.

Figure 11:
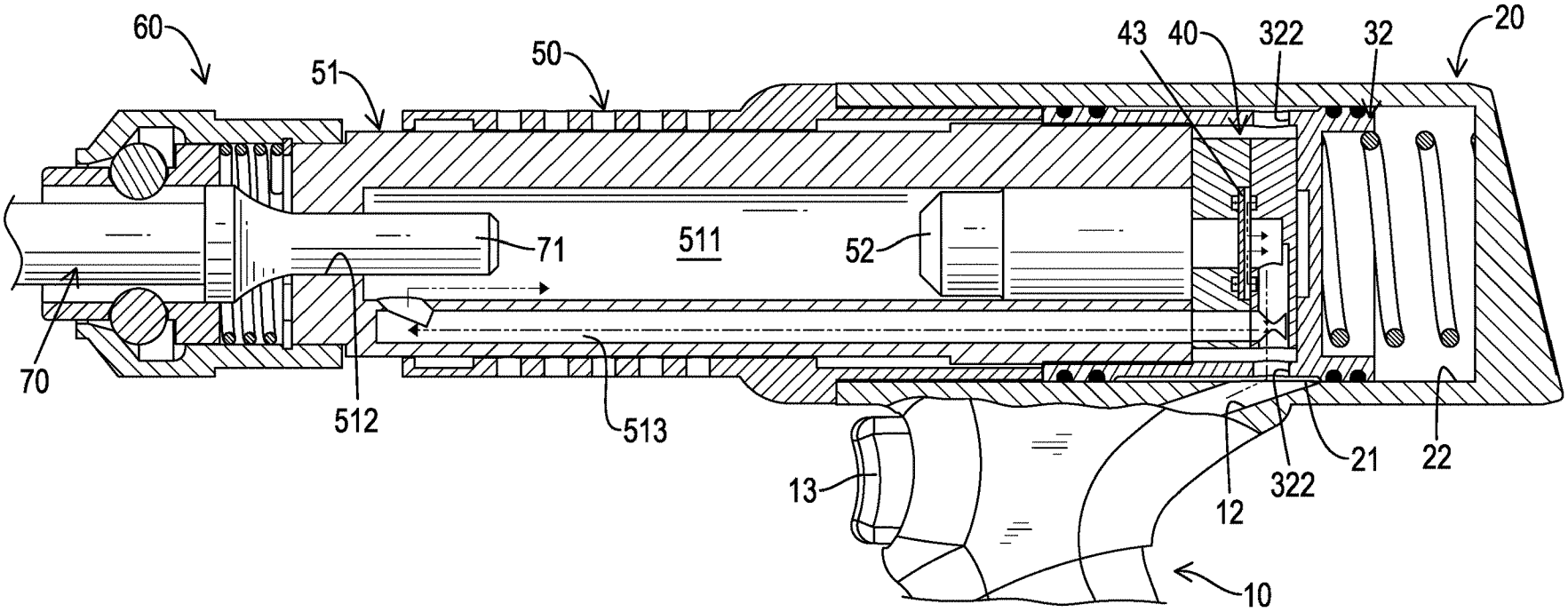
FIG. 11 is an operational side view in partial section of the pneumatic hammer in FIG. 1.
Figure 12:
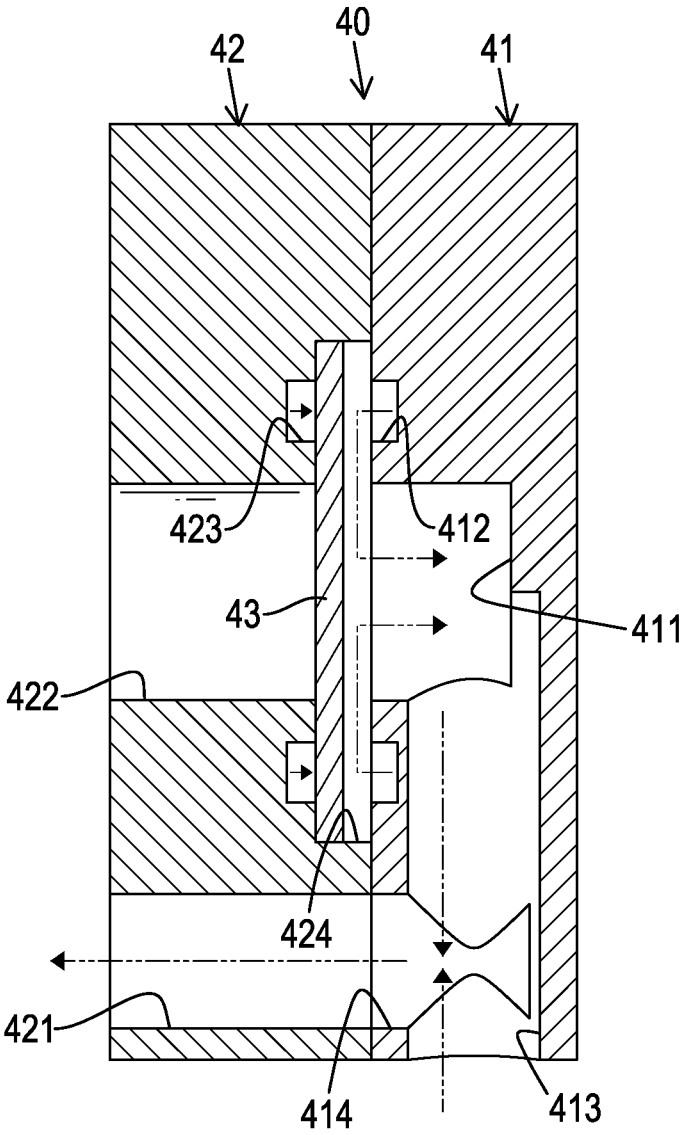
FIG. 12 is an operational and cross sectional side view of the valve seat of the pneumatic hammer in FIG. 3.

With reference to FIGS. 1, 11, and 12, before using the pneumatic hammer, the hammer 52 is mounted in the cylinder barrel 51 and abuts the front side of the front valve 42 of the valve seat 40, and the valve plate 43 is mounted in the movement space 424 opposite to the rear valve 41 to isolate the annular groove 423 and the inlet hole 422 of the front valve 42. The two L-shaped air channels formed by the exhaust channels 426 and the inlet channels 425 and the annular groove 423 of the front valve 40 form an independent system.

In use, the pneumatic hammer is connected to an air compressor, and the compressed air of the air compressor may flow into the annular space that is formed by the annular recess 321 and the chamber 22 via the wind passage 12 of the handle 10 and the vent 21 of the body 20. The compressed air further flows into the mounting room of the anti-shock mount 32 via the air inlets 322. A part of the compressed air flows into the annular groove 412 of the front valve 41 via the two L-shaped air channels of the front valve 41 and further flows into the inlet recess 411, the inlet passage 413 and the exhaust port 414 of the front valve 41. Then, the compressed air flows into the lower flow channel and the cylinder chamber 511 via the cylinder channel 513, and another part of the compressed air flows into the annular groove 423 of the front valve 42 via the two L-shaped air channels of the front valve 42.

When the valve plate 43 is disposed on the original position, the inlet recess 411, the annular groove 412, and the exhaust port 414 of the front valve 41 communicate with the exhaust port 421 of the front valve 42 and the cylinder chamber 511 and the cylinder channel 513 of the cylinder barrel 51 to form a communicating space that is larger than the independent system of the front valve 42. When the compressed air flows into the body 20, the pressure of the independent system is larger than the pressure of the communicating space, and this enables the valve plate 43 to move toward the rear valve 41 by the compressed air that flows from the annular groove 423 of the front valve 42 via the two L-shaped air channels of the front valve 42. Then, the annular groove 423 is not isolated by the valve plate 43 and communicates with the inlet hole 422, and the valve plate 43 abuts the rear valve 41 as shown in FIG. 14. Therefore, with reference to FIG. 13, the compressed air can flow into the cylinder chamber 511 via the inlet hole 422 to push the hammer 52 to knock against the connecting segment 71 of the chisel 70.

Figure 13:
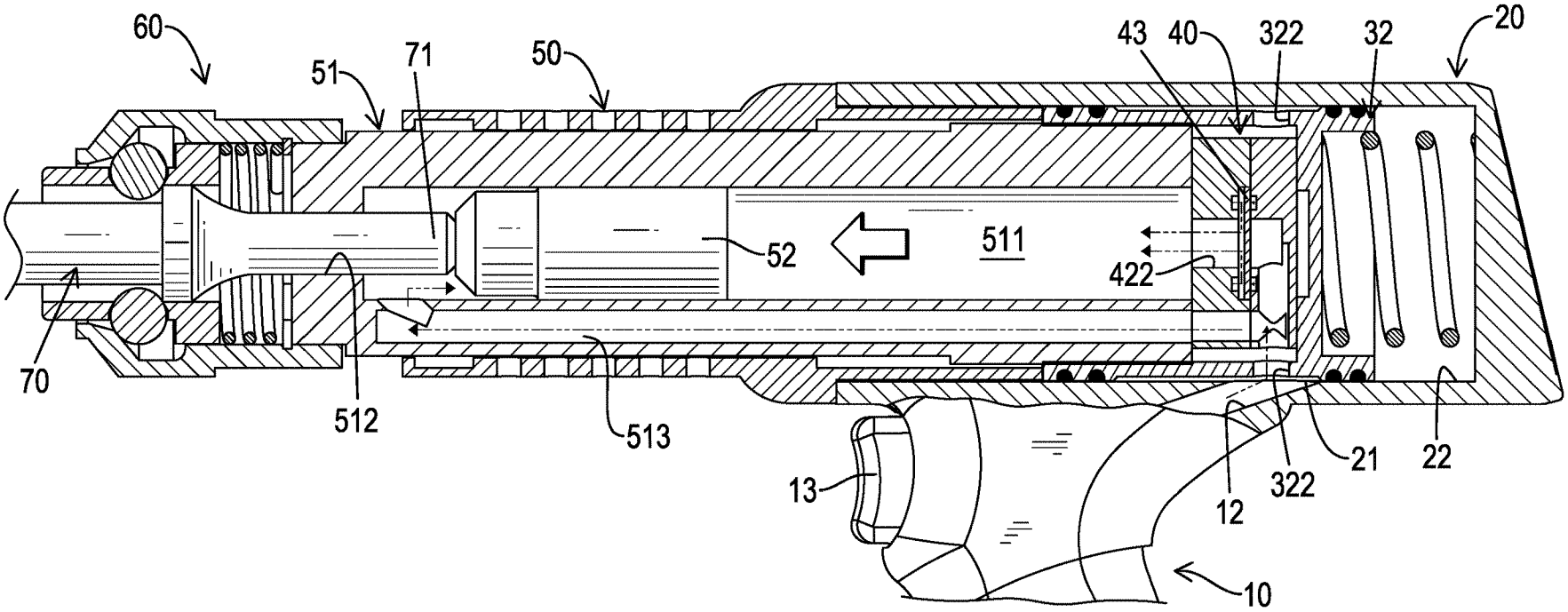
FIG. 13 is another operational side view in partial section of the pneumatic hammer in FIG. 1.
Figure 14:
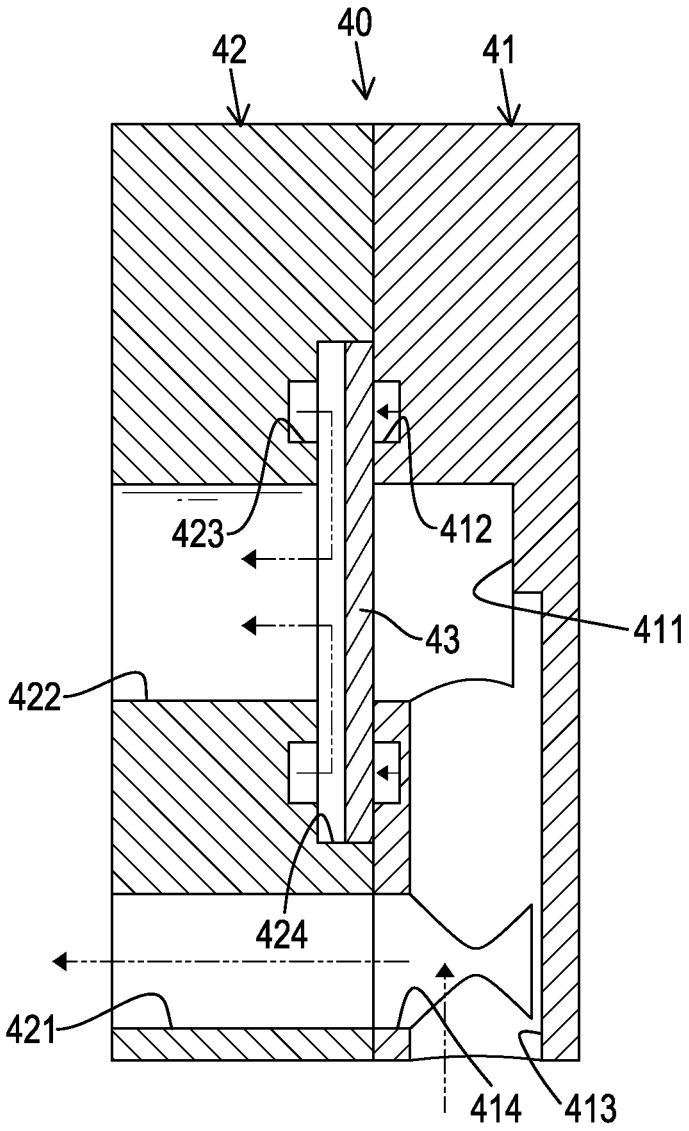
FIG. 14 is another operational and cross sectional side view of the valve seat of the pneumatic hammer in FIG. 3.
Figure 15:
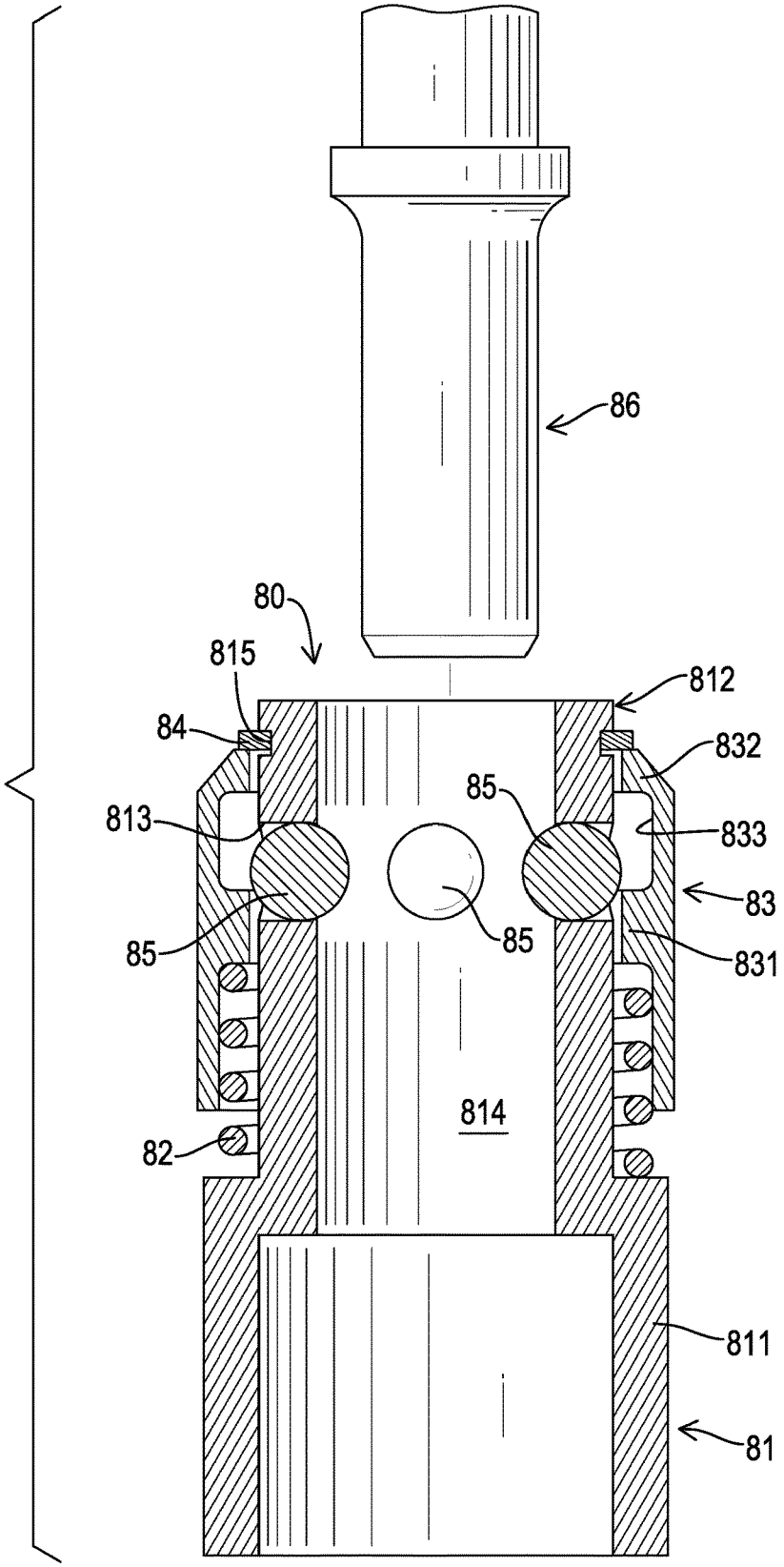
FIG.15 PRIOR ART
FIG. 15 is an exploded side view in partial section of a conventional pneumatic hammer in accordance with the prior art.
Figure 16:
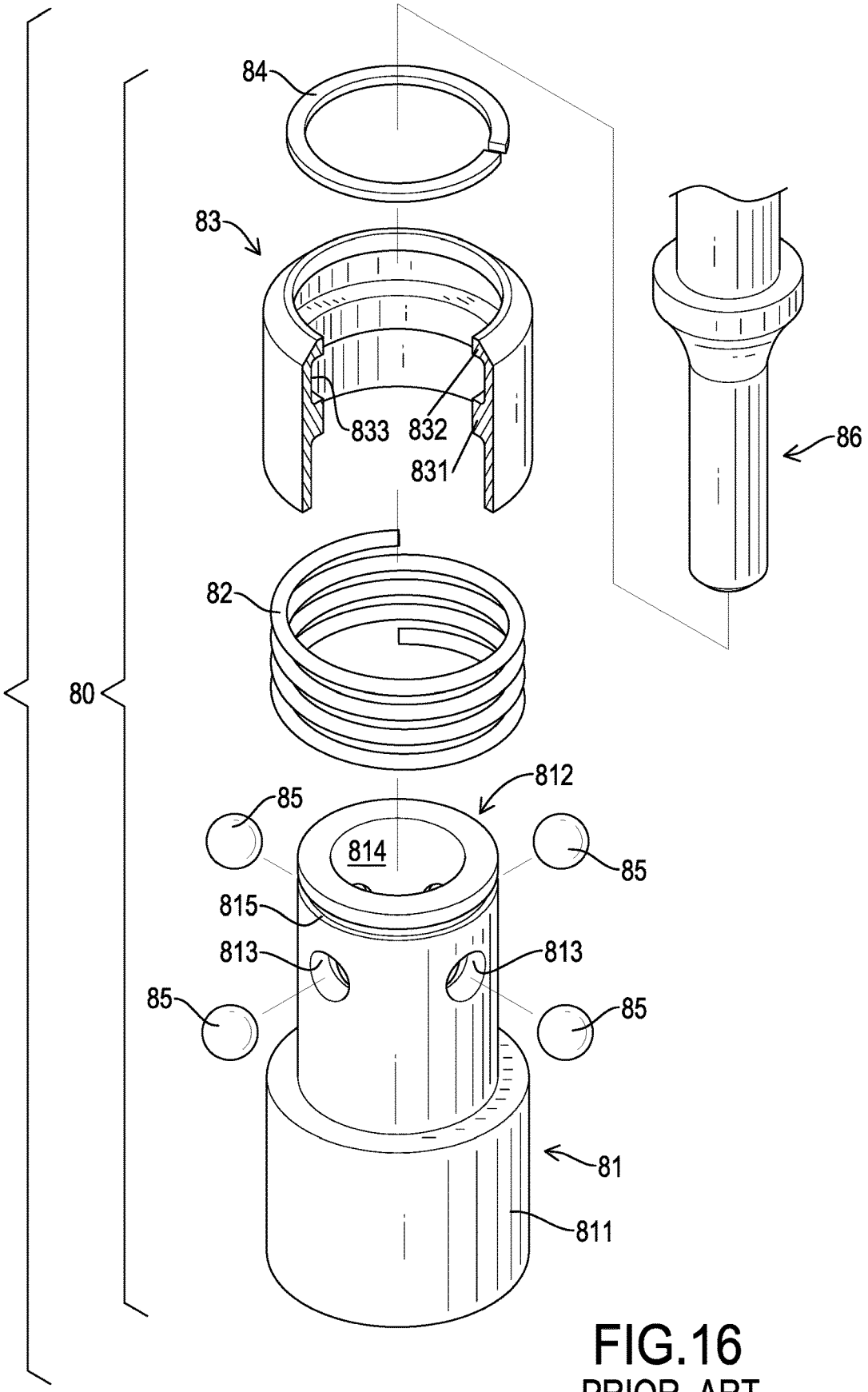
FIG.16 PRIOR ART
FIG. 16 is an exploded perspective view of the conventional pneumatic hammer in FIG. 15.
Figure 17:
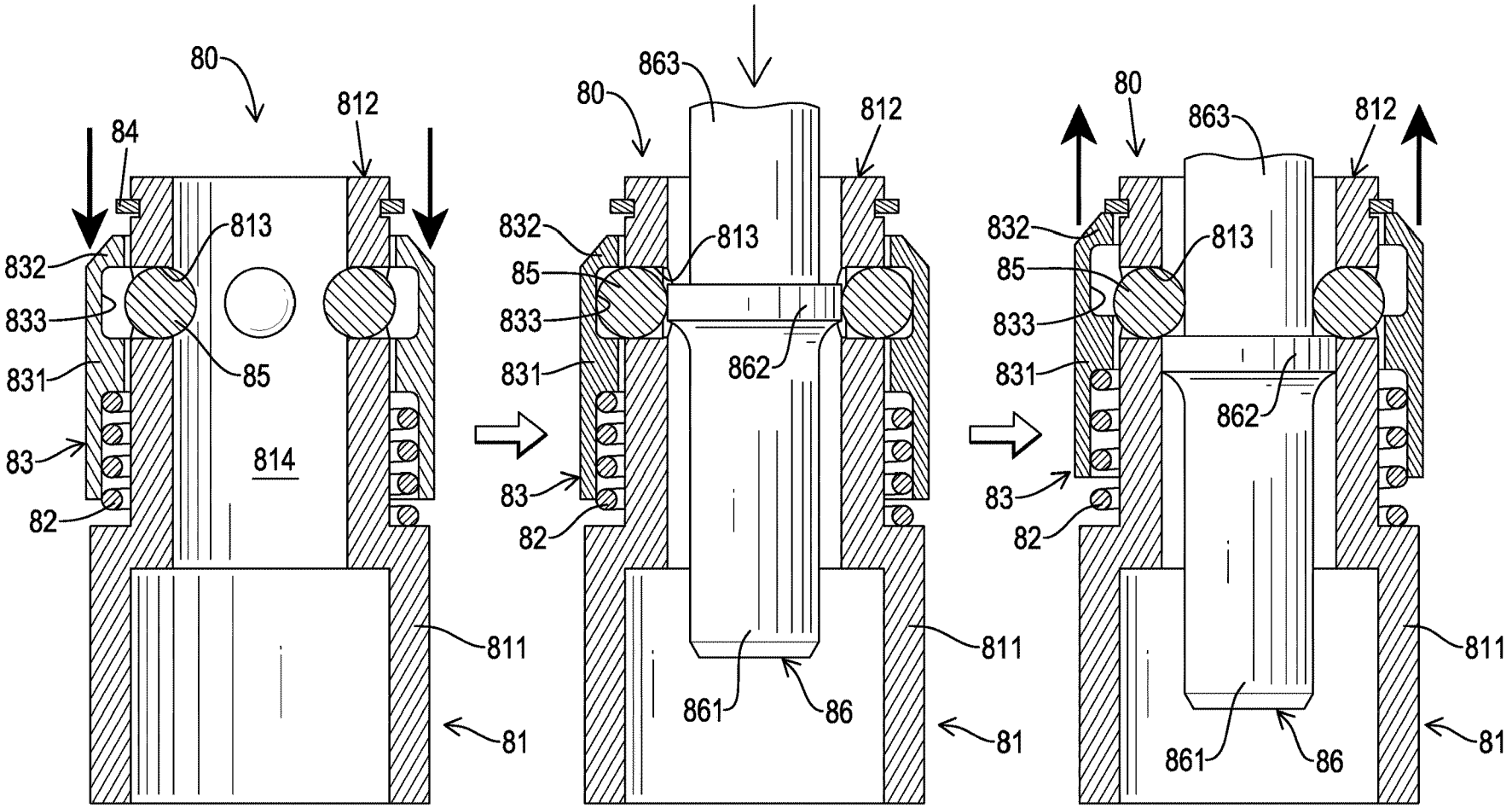
FIG.17 PRIOR ART
FIG. 17 shows operational side views in partial section of the conventional pneumatic hammer in FIG. 15.

With further reference to FIG. 13, when the hammer 52 knocks against the connecting segment 71 of the chisel 70, the valve plate 43 that is disposed in the movement space 424 abuts the rear valve 41 to isolate the annular groove 412 and the inlet recess 411 of the rear valve 41. At this time, the two L-shaped air channels formed by the inlet channels 415 and the exhaust channels of the rear valve 41 and the annular groove 412 form an independent system of the rear valve 41. Since the independent system of the front valve 42 communicates with a part of the valve seat 40 and has a pressure smaller than a pressure of the independent system of the rear valve 41, this enables air to flow into the annular groove 412 of the rear valve 41 via the independent system of the front valve 42 and push the valve plate 43 to move toward and abut against the front valve 42 as shown in FIGS. 11 and 12.

Then, the valve plate 43 isolates the annular groove 423 and the inlet hole 421 of the front valve 42, and air that flows into the annular groove 423 via the L-shaped air channels of the front valve 42 cannot flow in the inlet hole 422. At the same time, a part of air that flows into the annular groove 412 via the L-shaped air channels of the rear valve 41 flows into the inlet recess 411, the inlet passage 413, and the exhaust port 414 again. The part of air continuously flows in the rear valve 41 via the inlet passage 413 and into the lower flow channel together with air that flows in the inlet recess 411 of the rear valve 41. Then, the above-mentioned two parts of air flow in the cylinder chamber 511 via the cylinder channel 513. Since air cannot flow in the inlet hole 422 and the two parts of air flow in the cylinder chamber 511 via the cylinder channel 513, this enables the two parts of air that flow in the cylinder chamber 511 via the cylinder channel 513 to push the hammer 52 to move away from the chisel 70 and return to the original position.

When the valve plate 43 moves in the movement space 424 and abuts against the front valve 42, the valve plate 43 isolates the annular groove 423 and the inlet hole 422, and this enables the two L-shaped air channels of the front valve 42 and the annular groove 423 to form the independent system of the front valve 42. Furthermore, when the valve plate 43 moves to abut against the rear valve 41, the valve plate 43 isolates the annular groove 412 and the inlet recess 411, and this enables the two L-shaped air channels of the rear valve 41 and the annular groove 412 to form the independent system of the rear valve 41. When the independent system of the front valve 42 is formed, the pressure of the independent system of the front valve 42 is larger than that of the communicating space, and this enables the valve plate 43 to move toward the rear valve 41. Then, with reference to FIG. 12, air can flow into the cylinder chamber 511 via the inlet hole 422 and push the hammer 52 to move toward the chisel 70. When the independent system of the rear valve 41 is formed, the pressure of the independent system of the rear valve 41 is larger than that of other positions of the valve seat 40, and this enables the valve plate 43 to move toward the front valve 42 and to isolate the annular groove 423 and the inlet hole 422 of the front valve 42. Then, air cannot flow in the inlet hole 422 and flow into the cylinder chamber 511 via the cylinder channel 513 and push the hammer 52 to move away from the chisel 70 and return to the original position.

The pressures of the two independent systems of the rear valve 41 and the front valve 42 can be controlled by the movement of the valve plate 43 in the movement space 424, and this enables air to flow via the cylinder chamber 511 or the cylinder channel 513. Then, the hammer 52 repeatedly moves in the cylinder chamber 511 of the cylinder barrel 51 to repeatedly impact the chisel 70, so that the chisel 70 can exert an external force. Furthermore, the anti-shock device 30 is disposed in the body 20, and a recoil force received by the pneumatic hammer of the present invention can be alleviated when the hammer 52 repeatedly impacts the chisel 70 in the cylinder chamber 511.

Even though numerous characteristics and advantages of the present invention have been set forth in the foregoing description, together with details of the structure and features of the utility model, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pneumatic hammer comprising:

a handle having a top;

a body transversally connected to the top of the handle, communicating with the handle, and having a closed end;

an open end opposite to the closed end of the body;

an external surface; and a chamber formed in the body between the closed end and the open end of the body and communicating with the open end of the body;

a valve seat mounted in the chamber of the body adjacent to the closed end of the body and having a rear valve having a rear side;

a front side;

an external surface;

a center;

an inlet recess formed in the front side of the rear valve at the center of the rear valve opposite to the closed end of the body;

an annular groove annularly formed in the front side of the rear valve around the inlet recess at a spaced interval from the inlet recess;

an inlet passage radially formed through the external surface of the rear valve and communicating with the inlet recess;

an exhaust port axially formed in the front side of the rear valve and communicating with the inlet recess;

two inlet channels radially formed through the external surface of the rear valve; and two exhaust channels axially formed in a front side of the annular groove, and respectively communicating with the inlet channels, and each one of the exhaust channels and a corresponding inlet channel forming an L-shaped air channel to communicate with the annular groove;

a front valve connected to the rear valve; and a valve plate mounted between the rear valve and the front valve;

a cylinder device mounted in the chamber of the body via the open end of the body, abutting against the valve seat, and having a cylinder barrel mounted in the chamber via the open end of the body, abutting against the valve seat, and having a cylinder chamber axially formed in the cylinder barrel and communicating with the valve seat; and a hammer axially and movably mounted in the cylinder chamber of the cylinder barrel;

an assembling device connected to the cylinder barrel of the cylinder device opposite to the valve seat, communicating with the cylinder barrel, and having a mounting jacket being hollow and having a rear end;

a front end;

an internal surface;

an assembling chamber formed in the mounting jacket adjacent to the rear end of the mounting jacket and communicating with the cylinder barrel;

an engaging recess annularly formed in the internal surface of the mounting jacket adjacent to the assembling chamber and opposite to the rear end of the mounting jacket; and a mounting recess being conical, formed in the mounting jacket adjacent to the front end of the mounting jacket, communicating with the assembling chamber, and having a rear flange formed in the internal surface of the mounting jacket adjacent to the assembling chamber; and a front flange being tapered and formed in the internal surface of the mounting jacket adjacent to the front end of the mounting jacket;

an engaging element being hollow, mounted in the mounting jacket via the assembling chamber, extending out of the front end of the mounting jacket via the mounting recess, and having a front end extending out of the front end of the mounting jacket via the mounting recess;

a rear end;

an external surface;

a communicating hole axially formed through the front end and the rear end of the engaging element and communicating with the assembling chamber of the mounting jacket; and multiple assembling holes radially formed through the external surface of the engaging element at spaced intervals communicating with the communicating hole and the mounting recess of the mounting jacket, and each one of the assembling holes having two sectional inner diameters, one of the sectional inner diameters disposed adjacent to the communicating hole, and the other one of the sectional inner diameters disposed adjacent to the mounting recess and being larger than the sectional inner diameter that is disposed adjacent to the communicating hole;

multiple positioning elements respectively held in the assembling holes of the engaging element without falling in the communicating hole by the two sectional inner diameters of each one of the assembling holes, partially extending into the mounting recess of the mounting jacket, and abutting against the front flange of the mounting recess of the mounting jacket;

a spring mounted in the assembling chamber of the mounting jacket and abutting against the rear end of the engaging element; and an engaging ring disposed in the engaging recess of the mounting jacket and abutting against the spring to hold the spring in the mounting jacket by the engaging element and the engaging ring; and a chisel detachably connected to the assembling device and inserted into the cylinder chamber of the cylinder barrel of the cylinder device.

2. The pneumatic hammer as claimed in claim 1, wherein the front valve is connected to the rear valve, is mounted in the chamber of the body, and has a rear side;

a front side;

an external surface;

a center;

an exhaust port axially formed through the front side and the rear side of the front valve, the exhaust port aligning with and communicating with the exhaust port of the rear valve;

an inlet hole formed through the front side and the rear side of the front valve at the center of the front valve, the inlet hole aligning with and communicating with the inlet recess of the rear valve;

an annular groove annularly formed in the rear side of the front valve around the inlet hole at a spaced interval from the inlet hole;

a movement space formed in the rear side of the front valve around the annular groove, and communicating with the exhaust channels of the rear valve;

two inlet channels radially formed through the external surface of the front valve; and two exhaust channels axially formed in a rear side of the annular groove, and respectively communicating with the inlet channels, and each one of the exhaust channels and a corresponding inlet channel forming an L-shaped air channel to communicate with the annular groove, and the exhaust channels of the front valve respectively aligning with the exhaust channels of the rear valve, and the exhaust channels of the front valve communicating with the movement space.

3. The pneumatic hammer as claimed in claim 2, wherein the valve plate is movably deposited in the movement space of the front valve between the front valve and the rear valve;

the rear valve has two fixing holes axially formed through the front side of the rear valve;

the front valve has two fixing holes axially formed through the front side and the rear side of the front valve, and respectively aligning with the fixing holes of the rear valve; and the valve seat has two fixing pins, and each one of the fixing pins is mounted through a corresponding one of the fixing holes of the front valve, and is connected to one of the fixing holes of the rear valve that aligns with the corresponding one of the fixing holes of the front valve to connect and abut the front valve with the rear valve.

4. The pneumatic hammer as claimed in claim 3, wherein the rear valve, the front valve, and the valve plate are made of carbon fiber materials.

5. The pneumatic hammer as claimed in claim 4, wherein a stepped flange is formed between the annular groove and the inlet recess of the rear valve;

a steeped flange is formed between the annular groove and the inlet hole of the front valve;

the inlet channels of the rear valve align with each other; and the inlet channels of the front valve align with each other.

6. The pneumatic hammer as claimed in claim 5, wherein the pneumatic hammer has an anti-shock device mounted in the chamber of the body adjacent to the closed end of the body and having an elastic element mounted in the chamber of the body and having two ends, one of the two ends of the elastic element abutting against the closed end of the body; and an anti-shock mount mounted in the chamber of the body opposite to the closed end of the body, and having a closed end;

an open end;

an external surface;

an annular recess annularly formed on the external surface of the anti-shock mount between the closed end and the open end of the anti-shock mount;

an annular space formed between the annular recess and the chamber;

two air inlets radially formed through the external surface of the anti-shock mount adjacent to the closed end of the anti-shock mount, aligning with each other, and communicating with the annular space; and a mounting room formed in the anti-shock mount between the closed end and the open end of the anti-shock mount, and communicating with the air inlets and the open end of the anti-shock mount;

the valve seat is mounted in the mounting room of the anti-shock mount of the anti-shock device adjacent to the closed end of the anti-shock mount;

the rear valve is mounted in the mounting room of the anti-shock mount adjacent to the closed end of the anti-shock mount; and the front valve is mounted in the mounting room of the anti-shock mount adjacent to the rear valve.

7. The pneumatic hammer as claimed in claim 6, wherein the handle has a bottom;

an external surface;

an intake port disposed on the bottom of the handle to connect with an air compressor;

an air passage formed in the handle and communicating with the intake port;

a wind passage disposed on the top of the handle and selectively communicating with the air passage of the handle; and a switch pressably disposed on the external surface of the handle to control whether the wind passage communicates with the air passage of the handle; and the body communicates with the wind passage and has a vent formed through the external surface of the body adjacent to the closed end of the body and communicating with the wind passage of the handle.

8. The pneumatic hammer as claimed in claim 7, wherein the cylinder device abuts against the front side of the front valve of the valve seat; and the cylinder barrel has a rear end abutting against the front side of the front valve;

a front end;

a through hole axially formed through the front end of the cylinder barrel, communicating with the cylinder chamber, and having an inner diameter smaller than an inner diameter of the cylinder chamber; and a cylinder channel axially formed in the cylinder barrel, being parallel with the cylinder chamber, communicating with the cylinder chamber adjacent to the through hole, and communicating with the exhaust port of the front valve of the valve seat adjacent to the rear end of the cylinder barrel.

* * * * *